US006047432A

United States Patent [19]

Sode

[11] Patent Number: 6,047,432

[45] Date of Patent: Apr. 11, 2000

[54] DISPOSAL BRUSH

[76] Inventor: Jeffrey A. Sode, 562 Braemer, Barrington, Ill. 60010

[21] Appl. No.: 09/018,549

[22] Filed: Feb. 4, 1998

[51] Int. Cl.[7] ..... A46B 13/10

[52] U.S. Cl. ..... 15/160; 15/164; 15/206; 15/56; D4/131

[58] Field of Search ..... 15/160, 164, 165, 15/206, 56, 57, 59, 65, 67; D4/130, 131, 132, 133, 135, 136, 199

[56] References Cited

U.S. PATENT DOCUMENTS

| | | |
|---|---|---|
| D. 98,940 | 3/1936 | Hertzberg . |
| D. 274,273 | 6/1984 | Auerbach . |
| D. 362,966 | 10/1995 | Timmons . |
| 871,786 | 11/1907 | Cooperman . |
| 1,935,128 | 11/1933 | Pullman . |
| 2,279,209 | 4/1942 | Snyder . |
| 2,792,579 | 5/1957 | Roy . |
| 5,353,463 | 10/1994 | Bracy, Jr. . |
| 5,377,362 | 1/1995 | Jackson . |
| 5,423,621 | 6/1995 | Russell . |
| 5,617,605 | 4/1997 | Hoerner et al. . |

FOREIGN PATENT DOCUMENTS

| | | |
|---|---|---|
| 590315 | 6/1925 | France . |

*Primary Examiner*—Robert J. Warden, Sr.
*Assistant Examiner*—Jennifer C. McNeil
*Attorney, Agent, or Firm*—Olson & Hierl, Ltd.

[57] ABSTRACT

A disposal brush includes a plate having a hub and a handle for manipulating the disposal brush secured to the hub. Depending from the plate is a support frame carrying elongated bristles thereon. The support frame, which is made at least in part from a resilient material, includes a central portion secured to the plate and side arm portions extending downwardly and outwardly from the central portion. The ends of the side arm portions are each bent inwardly. In use, when the bristles on the side arms engage the inner side wall of the disposal unit, the side arms are urged inwardly. The reaction of the resilient side arms is to urge the bristles thereon more firmly against the inner wall of the disposal unit so as to enhance the cleaning thereof. The bristles on the inwardly bent portions will engage the top wall of the disposal as the disposal brush is withdrawn from the disposal so as to help clean the same. In a modification, the support frame includes an axially downwardly extending portion having upwardly and outwardly extending side arms connected thereto. Each of the side arms has an upwardly and inwardly extending portion. The bristles on the side arms and the upwardly and inwardly extending portions effectively clean both the side wall and the inner surface of the top wall of the disposal unit.

6 Claims, 2 Drawing Sheets

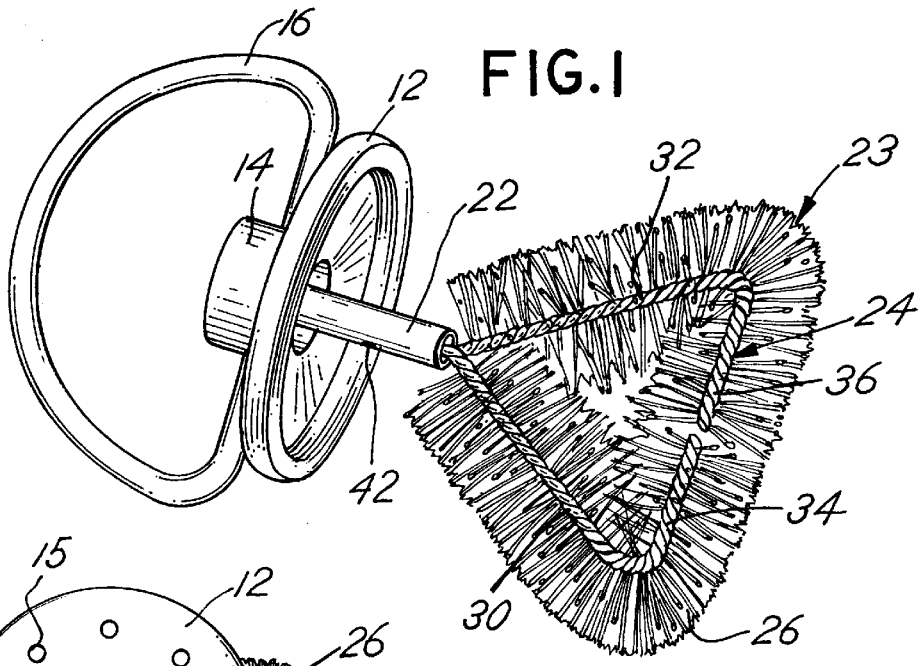
FIG.1
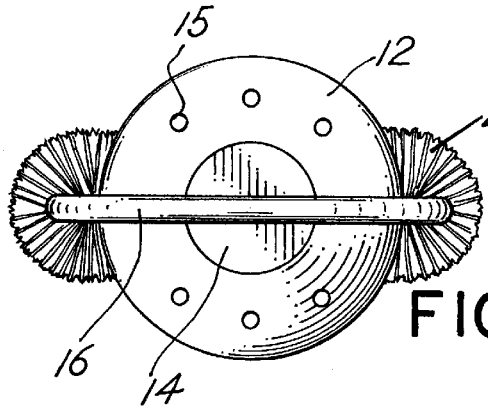
FIG.2
FIG.3
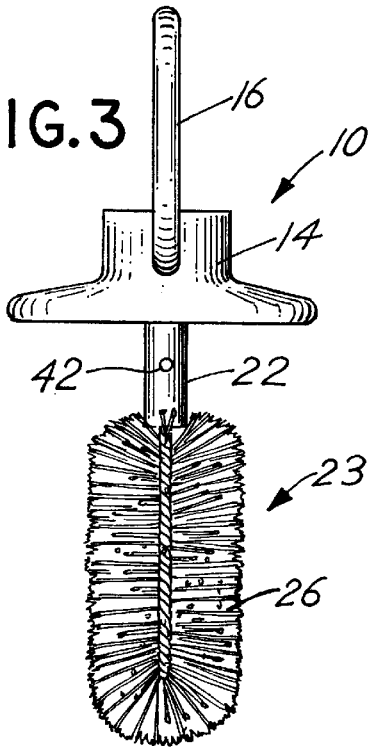
FIG.4
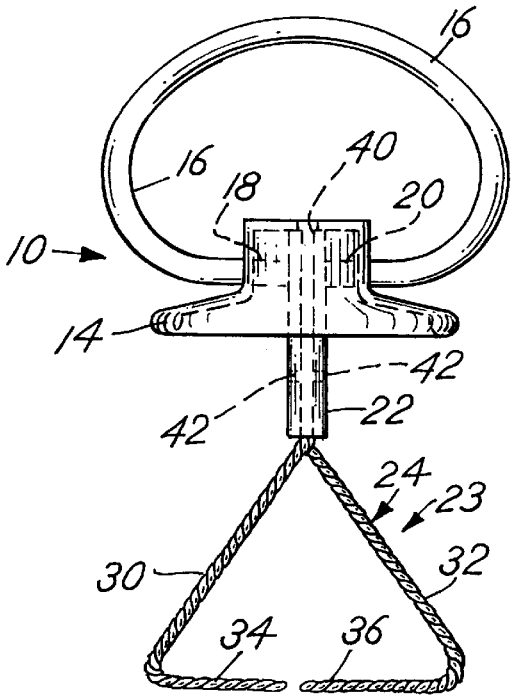

FIG. 5
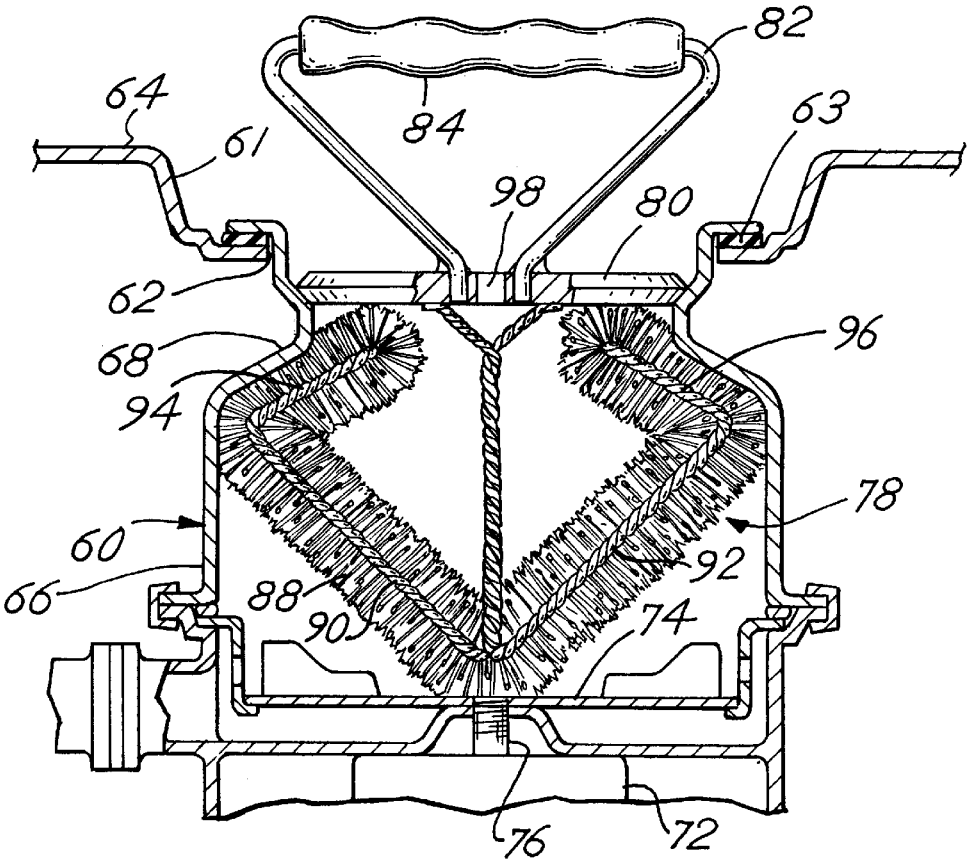
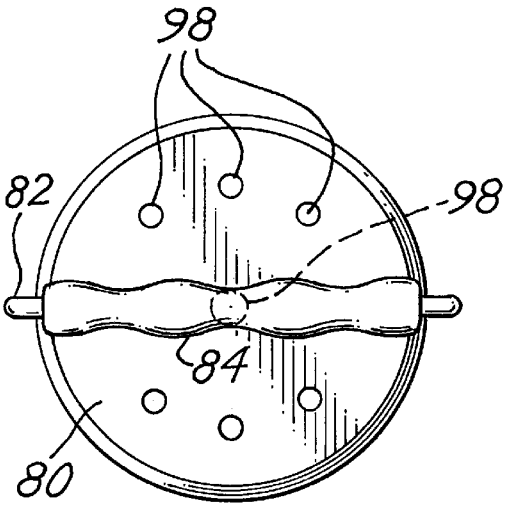
FIG. 6
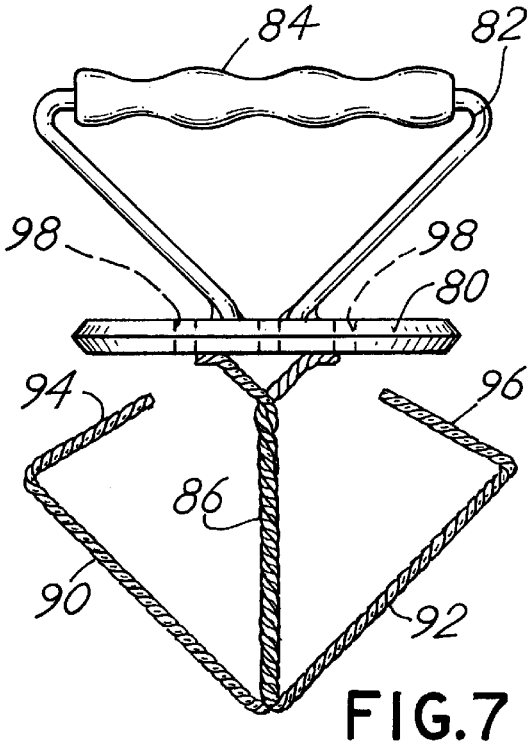
FIG. 7

DISPOSAL BRUSH

BACKGROUND OF THE INVENTION

This invention pertains to a disposal brush and, more particularly, to an improved disposal brush that can better clean the entire interior surface of a disposal in a sink.

Brushes for cleaning the interior surfaces of conduits, such as traps are known in the art. For example, Pullman No. 1,935,128 discloses a strainer trap for a drain pipe including a spiral core with bristles thereon for cleaning the center of the drain pipe. Other brushes are known for cleaning bottles. See, for example, Cooperman No. 871,786 and Timmons Des. 362,966. More recently, attention has been given to brushes and like utensils for better cleaning sinks and particularly, the disposals commonly used in modern sinks. Examples of more specialized brushes are seen in Auerbach Des. 274, 273, Bracy No. 5,353,463, Jackson 5,377,362, and Hoerner No. 5,617,605. Russell No. 5,423,621 reveals a garbage disposal cleaning device that includes a foldable splatter guard to shield and prevent splattering and which includes semi-soft non-abrasive bristles to allow cleaning of a garbage disposal without abrasive damage.

The present invention is directed to a new and novel disposal brush for cleaning the entire interior of a disposal unit in a sink in a safe and effective fashion.

An object of the present invention is to provide a novel disposal brush having a unique configuration that will permit the bristles on the brush to reach the sides and the top interior surfaces of the disposal and clean them effectively.

Another object of the present invention is to provide a novel disposal brush with a passage or passage that will facilitate the entry of a cleaning agent into the disposal to assist in the cleaning process.

Yet another object of the present invention is to provide a novel disposal brush with a handle that will permit easy manipulation of the disposal brush in use, said handle being secured to a plate that is adapted to fit the opening of the disposal and prevent splatter, and which has a support frame carrying bristles, which support frame is configured so that the bristles can reach the sides and the top interior surfaces of the disposal unit in the sink, and the plate having at least one opening therein to permit a cleaning detergent or like material to be supplied to the interior of the disposal unit when the disposal brush is in use.

Other objects and advantages of the present invention will become more apparent hereinafter.

BRIEF DESCRIPTION OF THE DRAWING

There is shown in the attached drawing a presently preferred embodiment of the present invention wherein like numbers in the various views refer to like elements and wherein:

FIG. 1 discloses a perspective view of a disposal brush embodying the present invention;

FIG. 2 illustrates a top plan view of the disposal brush;

FIG. 3 illustrates a side view of the disposal brush;

FIG. 4 illustrates a front elevation view of the disposal brush, with the brush bristles eliminated to better show the configuration of the support frame for the bristles;

FIG. 5 illustrates a side view of a modified disposal brush as positioned in a typical disposal;

FIG. 6 illustrates a top view of the modified disposal brush of FIG. 5; and FIG. 7 illustrates a front elevation view of the disposal brush of FIG. 5, with the brush bristles eliminated to better show the configuration of the support frame for the bristles.

DETAILED DESCRIPTION OF THE PRESENT INVENTION

There is shown in FIG. 1 the disposal brush 10 of the present invention. The disposal brush 10 includes a plate 12 to which is secured a hub 14 for receiving and securing a handle 16. The plate 12 may be fabricated from metal. The handle 16 may be formed from metal and suitably secured to the hub 14, which may also be formed from metal. Alternately, the plate 12 and the hub 14 may be unitarily molded from a suitable plastic. The hub 14 can be formed with openings 18, 20 (FIG. 4) in the sides thereof, which are adapted to receive the ends of the handle 16.

Secured to the plate 12 and extending downwardly therefrom as shown in FIGS. 1, 3, and 4, is the sleeve 22, which receives the brush portion 23 and which includes a support frame 24 carrying a plurality of bristles 26. The bristles 26 may be natural, but for reasons of cost, a suitable plastic, such as nylon, may be used. As best seen in FIGS. 1 and 4, the support frame 24 comprises a twisted wire that depends from and is secured within the sleeve 22 and then branches into separate side arms 30 and 32 which extend generally outwardly. The side arms 30 and 32 are each bent inwardly to form arm portions 34 and 36. The side arms 30 and 32 extend beyond the diameter of the plate 12 so as to be able to reach the sides of the inner wall of the disposal into which the disposal brush 10 is intended to be inserted when in use.

With reference to FIGS. 1 and 2, the plate 12 may be provided with openings 15. The openings 15 will enable water to enter the disposal even when the disposal brush 10 is in use with the plate 12 positioned against the top of the disposal opening in a sink.

With reference to FIG. 4, it is noted that a hole 40 is provided in the hub 14 and the plate 12 which forms a conduit with one or more transverse openings 42 by means of which a detergent or soap can be introduced into the disposal when the disposal brush 10 is in use.

In use, the disposal brush 10 is introduced into the opening in the sink for the disposal unit. The operator may introduce a soap or like detergent into the disposal through the hole 40 and opening or openings 42 in the disposal brush 10. The operator can rotate the disposal brush so that the bristles will engage and clean the interior of the disposal. The resiliency of the side arms 30 and 32 will cause them to react to the inward pressure created by the bristles 26 engaging the side wall of the disposal unit, and thereby the bristles 26 will engage the side walls at all times. When the disposal brush 10 is raised upwardly, the bristles 26 on the side arms 30 and 32 will engage the underside of the top of the disposal unit and clean same. If needed during the cleaning operation, additional detergent can be introduced into the disposal without removing the disposal brush from the disposal unit. Also, water to help flush the interior of the disposal unit, may pass through the opening 15 in the plate 12 when the plate is seated against the top of the disposal unit.

Turning to FIGS. 5–7, there is shown a modification of the present invention which is configured to better address the problem of cleaning the underside of the top of the disposal unit. As seen in FIG. 5, the disposal unit 60 engages within an opening 62 in a recessed portion 61 in the bottom of the sink 64. A resilient seal 63 is provided between the flange at the top of the disposal unit 10 and the upper surface of the sink. The disposal unit 60 is generally cylindrical and has a side wall 66, a top wall 68 and a bottom wall 70. Secured to the bottom wall 70 in a suitable manner is an electric motor 72 that is connected to the grinder blade 74 by a drive shaft 76 for comminuting refuse fed to the disposal 60.

The disposal brush 78 includes a plate 80, to which is operatively connected a handle 82 for manipulating the disposal brush 78. The top of the handle 82 is provided with a grip 84 fabricated of rubber or plastic to facilitate the fingers gripping the handle 82.

Secured to the plate 80 and extending downwardly therefrom as shown in FIGS. 5 and 7 is a support frame 86 carrying a plurality of bristles 88. The bristles 88 may be natural, or they may be made from a suitable plastic, such as, nylon. The support frame 86 preferably comprises twisted wire that depends downwardly from the plate 80 along the vertical axis through the plate 80 and which includes upwardly and outwardly extending side arms 90 and 92, each of which has an upwardly and inwardly portion 94 and 96. The side arms 90 and 92 extend beyond the diameter of the plate 80 so that the bristles 88 carried thereon will be able to reach the side wall 66 of the disposal, as well as the underside of the top wall 68 of the disposal 60. The disposal brush 78 may be sufficiently long so as to contact the grinder blade 74 or it can be a bit shorter so as not to contact the grinder blade.

With reference to FIG. 6, it is seen that the plate 80 is provided with a plurality of openings 98. The openings 98 can be varied in number and in size as desired. One opening 98 may be on the axis of the plate 80, as best seen in FIG. 5 and 7, or the openings 98 can be spaced from the axis, as best seen in FIGS. 6 and 7. It will be understood that one or more of the openings 98 may be used to introduce a soap or detergent in the disposal when the brush is in use. In addition, water may be introduced into the disposal unit through the holes 98 in order to help flush dirt down the drain from the sink, even if the plate 80 were in position to slow or stop the flow of water.

The disposal brush 78 is used in basically the same manner as the disposal brush 10. The disposal brush 78 is introduced into the disposal unit 60 through the opening in the top thereof. The operator may introduce soap or a detergent into the disposal unit 60 through one of the openings 98. The operator can rotate the disposal brush 78 so that the bristles 88 will engage and clean the side wall 66 and the underside of the top wall 68 of the disposal unit 60. Because of the configuration of the side arms, the bristles 88 on the side arm portions 94 and 96 readily engage and clean even the corner between the side wall 66 and the top wall 68 of the disposal unit 60.

While I have shown a presently preferred embodiment of the present invention, it is apparent to persons of ordinary skill in the art that the invention may be otherwise embodied within the scope of the following claims.

I claim:

1. A disposal brush for cleaning a disposal unit in a sink, said disposal unit having a generally cylindrical side wall, a top wall and a bottom wall, said disposal brush comprising a generally circular plate having a size sufficient to cover the opening of the disposal unit, a handle affixed to the plate, a support frame secured to and depending downwardly from the plate, said support frame including a central portion, side arms extending upwardly toward the circular plate and outwardly from the central portion and having upwardly and inwardly bent portions at the ends thereof, and bristles secured along the length of the side arms and the inwardly bent portions at the ends thereof, the side arms and the inwardly bent portions being resilient, whereby in use, when the disposal brush is inserted into the disposal, the bristles on the side arms will engage the side wall of the disposal unit, which will tend to urge the side arms inwardly, and the reaction of the resilient side arms will be to urge the bristles on the side arms into firmer engagement with the side wall of the disposal unit, and when the bristles on the inwardly bent portions engage the inside of the top wall of the disposal unit, the bristles on the upwardly and inwardly extending portions will be urged into engagement with the side wall and the top wall of the disposal unit for effectively cleaning both the side wall and the top wall.

2. A disposal brush as in claim 1 wherein an opening is provided in the plate in order to permit a detergent to be introduced into the disposal unit through the plate when the disposal brush is being used.

3. A disposal brush as in claim 1 wherein an opening is provided in the plate in order to permit water to enter the disposal unit to flush same during the cleaning operation.

4. A disposal brush as in claim 1 wherein the handle is provided with a finger grip to facilitate handling of the disposal brush when in use.

5. A disposal brush as in claim 4 wherein the handle has a portion extending substantially parallel to the circular plate and the finger grip is on said portion extending substantially parallel to the circular plate.

6. A disposal brush as in claim 1 wherein the support frame is comprised of twisted wire.

* * * * *